United States Patent [19]

Mertz

[11] Patent Number: 4,853,976

[45] Date of Patent: Aug. 8, 1989

[54] INSULATIVE SWIMMING SUITS FOR CHILDREN

[76] Inventor: Gail Mertiz, 2380 Berkley, La Habra, CA 90631

[21] Appl. No.: 160,767

[22] Filed: Feb. 26, 1988

[51] Int. Cl.[4] ..... A41D 7/00

[52] U.S. Cl. ..... 2/67; 2/80; 2/272

[58] Field of Search ..... 2/67, 21 R, 272, 69, 2/80, 83, 79

[56] References Cited

U.S. PATENT DOCUMENTS

| | | | |
|---|---|---|---|
| 259,020 | 6/1882 | Hutton | 2/67 |
| 318,133 | 5/1885 | Pfister | 2/67 |
| 1,989,753 | 2/1935 | Ide | 2/67 |
| 3,134,994 | 6/1964 | Christofferson | 2/67 X |
| 3,392,730 | 7/1968 | Relli | 2/67 X |
| 3,436,762 | 4/1969 | Cahan | 2/67 |
| 3,512,179 | 5/1970 | Stamatiou | 2/67 |
| 4,369,528 | 1/1983 | Vest et al. | 2/69 |

*Primary Examiner*—H. Hampton Hunter

*Attorney, Agent, or Firm*—Edgar W. Averill, Jr.

[57] ABSTRACT

A swimming suit for infants and children which helps keep the child warm by reducing body heat loss to the water. The suit has a body portion extending from the shoulders to the tops of the legs and the body portion is fabricated from double-layered material. Right and left arms and right and left legs are attached to the body portion.

8 Claims, 1 Drawing Sheet

INSULATIVE SWIMMING SUITS FOR CHILDREN

BACKGROUND OF THE INVENTION

The field of the invention is swimming suits and the invention relates more particularly to swimming suits for infants and children from about the age of eighteen months to six years.

It is important for children to learn to swim and this is especially true for children who live around swimming pools, lakes or the ocean. A major problem with teaching children to swim is the discomfort caused by the children being too cold during swimming lessons The process of learning to swim often involves standing in shallow water, or being held in shallow water, while various swimming techniques are taught. Because this process is often not as active as actual swimming, the child often does not generate as much internal heat as he or she is losing and becomes cold and must get out of the water, thereby terminating the swimming lesson.

Although wet suits made from foam rubber material are commonly used for adults to reduce heat loss in the water, such wet suits can inhibit movement, are expensive and are quickly outgrown by a growing child. Furthermore, such wet suits reduce the ability of the child to feel the teacher's hands holding them and can increase anxiety during learning.

SUMMARY OF THE INVENTION

It is an object of the present invention to provide a swimming suit for infants and children which reduces the loss of body heat from the wearer to the water.

The present invention is for a swimming suit for infants and children which reduces body heat loss to the water. The suit comprises a body portion extending from the shoulders to the tops of the legs, the body portion being fabricated from double-layered material, and said body portion including a front and a back. Right and left arm portions are attached to the body portion and extend out to the wrist area. Right and left leg portions are also attached to the body portion and extend to at least beyond the knee area. Preferably, the suit is fabricated from a synthetic fabric exhibiting the quality of two-way stretch. A V-shaped opening in the back of the suit facilitates the putting on and taking off of the suit

DESCRIPTION OF THE PREFERRED EMBODIMENTS

Figure 1:
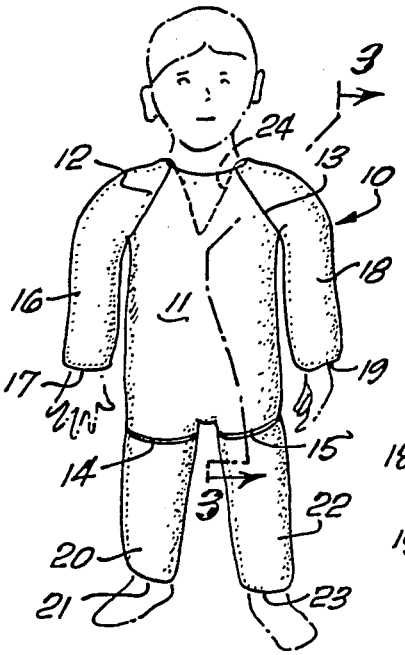
FIG. 1 is a front view of the swimming suit of the present invention.

The swimming suit of the present invention is shown in FIG. 1 and indicated generally by reference character 10. Swimming suit 10 has a body portion 11 which extends from a right arm seam 12 and a left arm seam 13 to a right leg seam 14 and a left leg seam 15. Body portion 11 is fabricated from a double layer of fabric as shown best in FIG. 3 of the drawings The fabric is preferably a synthetic fabric which tends to dry more quickly. The fabric is also, preferably, of the type which stretches in two directions so that it may be form-fitting and retain an insulative layer of water between the suit and the child's body. A preferred fabric is sold under the trademark, "Lycra." Suit 10 also has a right arm portion 16 which extends about to the wrist 17. Left arm 18 extends from left arm seam 13 to the wrist portion 19. Similarly, right leg 20 extends from seam 14 to the bottom 21 which is about the wearer's ankle. Similarly, left leg portion 22 extends from seam 15 to the bottom 23 which is also at about the ankle of the wearer.

Figure 2:
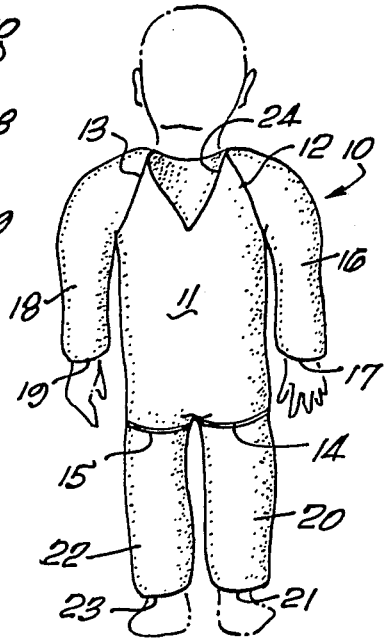
FIG. 2 is a back view thereof.

The back of the suit is shown in FIG. 2 and the back of the body portion is also double-layered for insulation. The back also has a V-shaped opening 24 which facilitates the putting on and taking off of the suit. By the use of V-shaped opening 24, no zipper or other opening is necessary.

Figure 4:
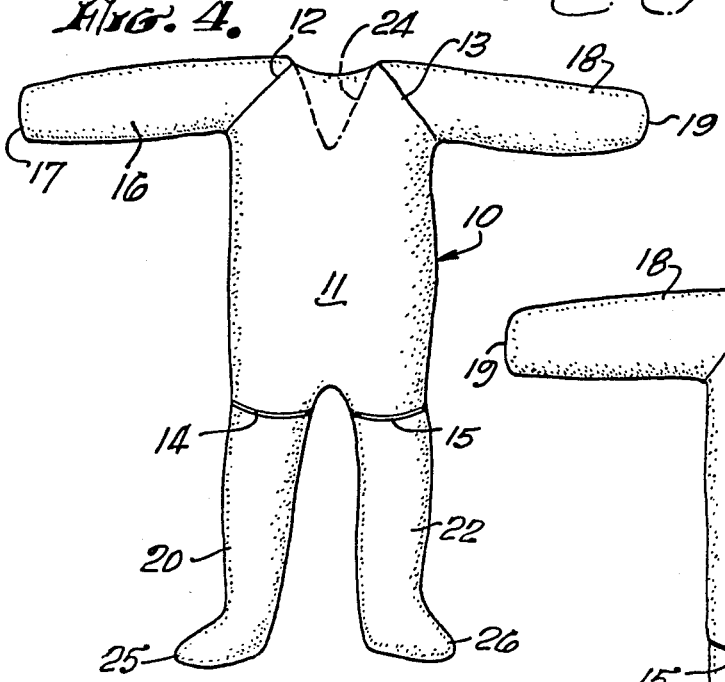
FIG. 4 is a front view of an alternate embodiment of the swimming suit of the present invention.
Figure 5:
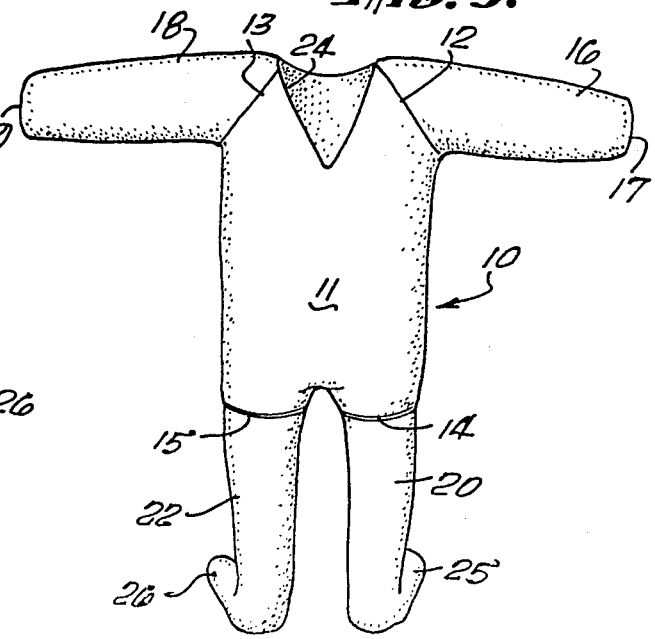
FIG. 5 is a back view of the swimming suit of FIG. 4.

An alternate configuration of the insulative suit of the present invention is shown in FIGS. 4 and 5 where foot portions 25 and 26 are integral with right and left legs 20 and 22, respectively.

The suit of the present invention has been found particularly useful for children from the age of about nine months to a year to eighteen months, depending upon the individual, to about the age of six. It is at this age that swimming lessons are particularly useful for safety reasons, and the double layer over the torso of the child retains enough heat so that the child may continue the lesson to its conclusion without becoming chilled.

Figure 3:
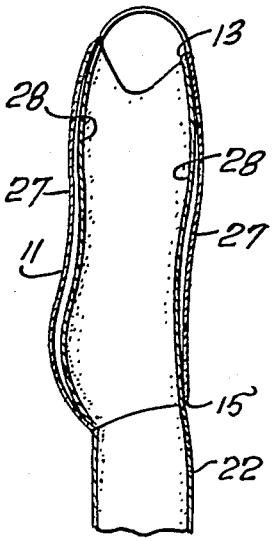
FIG. 3 is a cross-sectional view taken along line 3—3 of FIG. 1.

The double layer is shown best in FIG. 3 of the drawings where an outer layer 27 is in close proximity with an inner layer 28. When the outer and inner layers are made from a material exhibiting a two-way stretch, they are held closely together and retain a certain amount of water both between the child's skin and inner layer 28 and between inner layer 28 and outer layer 27. This greatly reduces the flow of heat from the torso to the water. At the same time, the single layer over the arms and legs slightly reduces heat loss while permitting completely free movement of both the arms and the legs. Although the V-shaped opening 24 facilitates the putting on and removing of the suit, it is not essential for the practice of the present invention. For instance, a larger neck size could be used in place of V-shaped opening 24.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A swimming suit for infants and children which reduces body heat loss to the water, said suit comprising:

a body portion extending from the shoulders to the tops of the legs, said body portion being fabricated from double-layered material, said body portion including a front and a back;

right and left arm portions attached to said body portion and extending about to the wrist area; and right and left leg portions attached to the body portion and extending to at least beyond the knee area.

2. The swimming suit for infants and children of claim 1 wherein said suit is fabricated substantially from synthetic fabric exhibiting the quality of two-way stretch.

3. The swimming suit for infants and children of claim 1 wherein the leg portions extend over the feet.

4. The swimming suit for infants and children of claim 1 wherein the arm portions are fabricated from single-layered material.

5. The swimming suit for infants and children of claim 1 wherein the leg portions are fabricated from single-layered material.

6. The swimming suit for infants and children of claim 1 wherein the body portion has a V-shaped opening at the top of the back thereof.

7. A swimming suit for infants and children which reduces body heat loss to the water, said suit comprising:

a body portion extending from the shoulders to the tops of the legs, said body portion being fabricated from double-layered material, said body portion including a front and a back, and the back thereof including a V-shaped opening to facilitate the putting on of the suit;

right and left arm portions attached to said body portion and extending about to the wrist area, said right and left arm portions being fabricated of single-layered material; and right and left leg portions attached to the body portion and extending to at least beyond the knee area, said right and left leg portions being fabricated from single-layered material.

8. The swimming suit for infants and children of claim 7 wherein said suit is fabricated from synthetic fabric exhibiting the quality of two-way stretch.

* * * * *